US006703942B1

(12) United States Patent
Borelli et al.

(10) Patent No.: US 6,703,942 B1
(45) Date of Patent: Mar. 9, 2004

(54) MEASURING SYSTEM USING DETACHABLE READING/PROGRAMMING MEANS

(75) Inventors: Riccardo Borelli, Lenno (IT); Gianfranco Bianchi, San Fermo Della Battaglia (IT)

(73) Assignee: ABB Sace S.p.A., Milan (IT)

( * ) Notice: Subject to any disclaimer, the term of this patent is extended or adjusted under 35 U.S.C. 154(b) by 0 days.

(21) Appl. No.: 09/786,766

(22) PCT Filed: Sep. 13, 1999

(86) PCT No.: PCT/EP99/06774

§ 371 (c)(1),
(2), (4) Date: Mar. 9, 2001

(87) PCT Pub. No.: WO00/16290

PCT Pub. Date: Mar. 23, 2000

(30) Foreign Application Priority Data

Sep. 16, 1998 (IT) ..... MI98A2015

(51) Int. Cl.[7] ..... G08C 19/38

(52) U.S. Cl. ..... 340/870.3; 340/870.07; 340/310.06

(58) Field of Search ..... 340/870.03, 870.07, 340/310.06, 310.07, 870.3; 700/67

(56) References Cited

U.S. PATENT DOCUMENTS 4,691,328 A 9/1987 Sterling, Jr. et al.
4,777,331 A 10/1988 Borst
5,434,774 A * 7/1995 Seberger ..... 340/870.07

OTHER PUBLICATIONS

Lattka A L: "Smartes Messen Im Prozess" Elektrotechnik, DE, Vogel Verlag K.G. Wurzburg, vol. 73, No. 9, Sep. 20, 1991, p. 36–38 XP000264646 ISSN: 1431–9578, p. 36, middle column, line 1—p. 36, middle column, line 21 figure 2.

* cited by examiner

*Primary Examiner*—Timothy Edwards
(74) *Attorney, Agent, or Firm*—Guido Modiano; Albert Josif; Daniel O'Byrne

(57) ABSTRACT

An industrial system for measuring a physical quantity, related to an industrial process and/or application, comprising:

first means for detecting said physical quantity and for transmitting first data and/or signals related to said physical quantity;

second means for receiving said first data and/or signals, said second means being connected to said first means through one or more data/signal transmission lines;

third means for reading said first data and/or signals and for programming said first means, said third means being detachable from said means and fixable in a remote position from said first means.

8 Claims, 1 Drawing Sheet

MEASURING SYSTEM USING DETACHABLE READING/PROGRAMMING MEANS

The present invention relates to an industrial system for measuring a physical quantity (such pressure, temperature and the like) related, for example, to a process and/or plant.

More particularly, the present invention relates to an industrial measuring system, which allows, for example, performing the remote programming of one or more industrial transmitters using detachable reading/programming means that can be placed remotely from said industrial transmitters.

Many systems for measuring a physical quantity of an industrial process and/or application are known in the state of the art.

Common measuring systems generally adopt one or more industrial transmitters for detecting the industrial physical quantity to be measured and for transmitting data and/or signals to a receiving control unit. So, industrial transmitters are placed at a desired point of the industrial process or plant and they report to the user the measurement of the monitored physical quantity.

It is also known that, generally, industrial transmitters need to be programmed during their operation, for example in order to perform adjustments that allow to perform the measurement of the monitored physical quantity with the requested accuracy. For example, in case of pressure measurements of an industrial fluid, zero and span adjustments are commonly performed. For this aim, reading/programming devices (often called "calibration meters") are generally used. Commonly, they are fixed either directly on the transmitter itself or generally immediately downstream of it for performing this kind of programming. This fact entails disadvantages in their installations and considerable difficulties in their use, since, very often, said industrial transmitters are not in positions which can be easily accessed by users. This entails all important increase of the installation and maintenance costs of the whole industrial measuring system.

The aim of the present invention is to provide a system for measuring a physical quantity, related to an industrial process and/or plant, which adopts one or more reading/programming devices that can be installed in a remote position with respect to the corresponding industrial transmitter.

Within the scope of this aim, an object of the present invention is to provide a system for measuring a physical quantity, related to an industrial process and/or plant, which adopts one or more reading/programming devices which can be remotely supplied.

Another object of the present invention is to provide a system for measuring a physical quantity, related to an industrial process and/or plant, which adopts one or more reading/programming devices that use a standard communications protocol.

Another object of the present invention is to provide a system for measuring a physical quantity, related to an industrial process and/or plant, which adopts one or more reading/programming devices which can be easily adapted to conventional industrial transmitters with an high level of reliability.

Thus the present invention provides an industrial system for measuring a physical quantity comprising:

first means for detecting said physical quantity and for transmitting first data and/or signals related to said physical quantity;

second means for receiving said first data and/or signals, said second means being connected to said first means through one or more data/signal transmission lines;

third means for reading said first data and/or signals and for programming said first means, said third means being detachable from said means and fixable in a remote position from said first means.

Further characteristics and advantages of the invention will become apparent from the description of a preferred but not exclusive embodiment of the system according to the invention, illustrated only by way of example in the accompanying drawings, wherein.

With reference to the above figures, the system, according to the present invention, comprises first means 10 for detecting a physical quantity, related for example to an industrial process and/or plant. Said physical quantity can be, for example, the pressure or the temperature of a fluid in a pipeline. First means 10 are also used for transmitting first data and/or signals, related to said physical quantity, to second means 11 that receive said first data and that are connected to the first means 10 through one or more data/signal communication lines 13.

Figure 2:
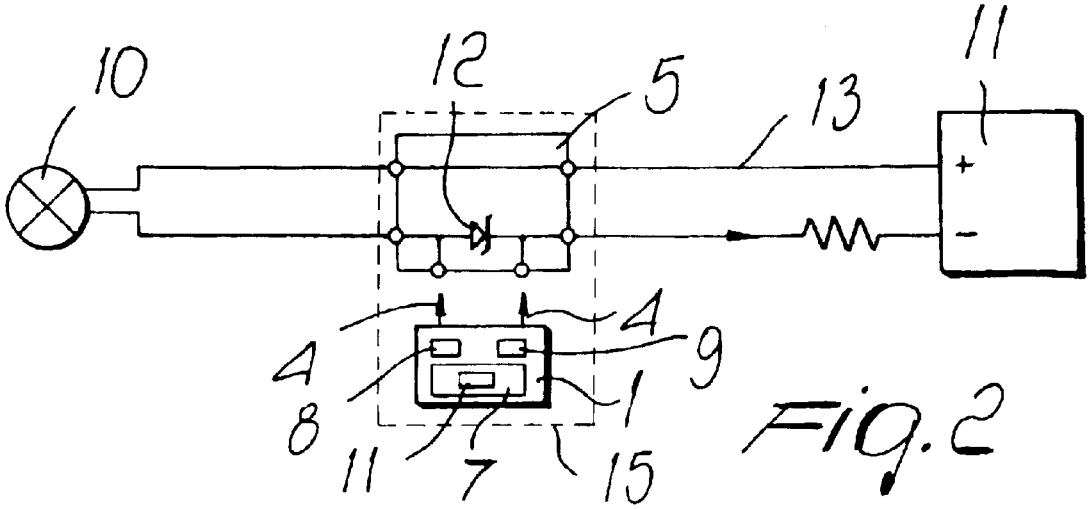
FIG. 2 is a simplified circuit diagram of the system according to the present invention.

First means 10 can be one or more industrial transmitters (for example pressure and/or temperature transmitters) while second means 11 can be, for example, the receiving unit of an industrial process control system. Lines 13 can be preferably 4–20 mA communication lines, widely known to those skilled in the art. The system according to the present invention comprises also third means 15, for reading the first data transmitted through the lines 13 and for programming the first means 10. The main characteristic of said third means 15 is that they are detachable and can be fixed in a remote position from said first means 10 (as illustrated in FIG. 2). This solution allows performing the programming, for example, for calibration adjustments of the industrial transmitters comprised in first means 10, in an easy way even if the industrial transmitters are placed in positions that are of difficult access.

Advantageously third means (10) 15 comprise a portable reading/programming unit 1, which can be provided with fourth means for programming instructions and/or signals to said first means 10. Fourth means can be, for example, the programming buttons 3 of FIG. (2) 1. The portable unit 1 can also be provided with fifth means for exchanging instructions and/or signals with the first means 10. In an advantageous embodiment, said fifth means can comprise means for performing data and/or signal communication through a standard protocol such as, for example, a modem 8 for connection by means of a standard communications protocol (e.g. an HART communication protocol).

Figure 1:
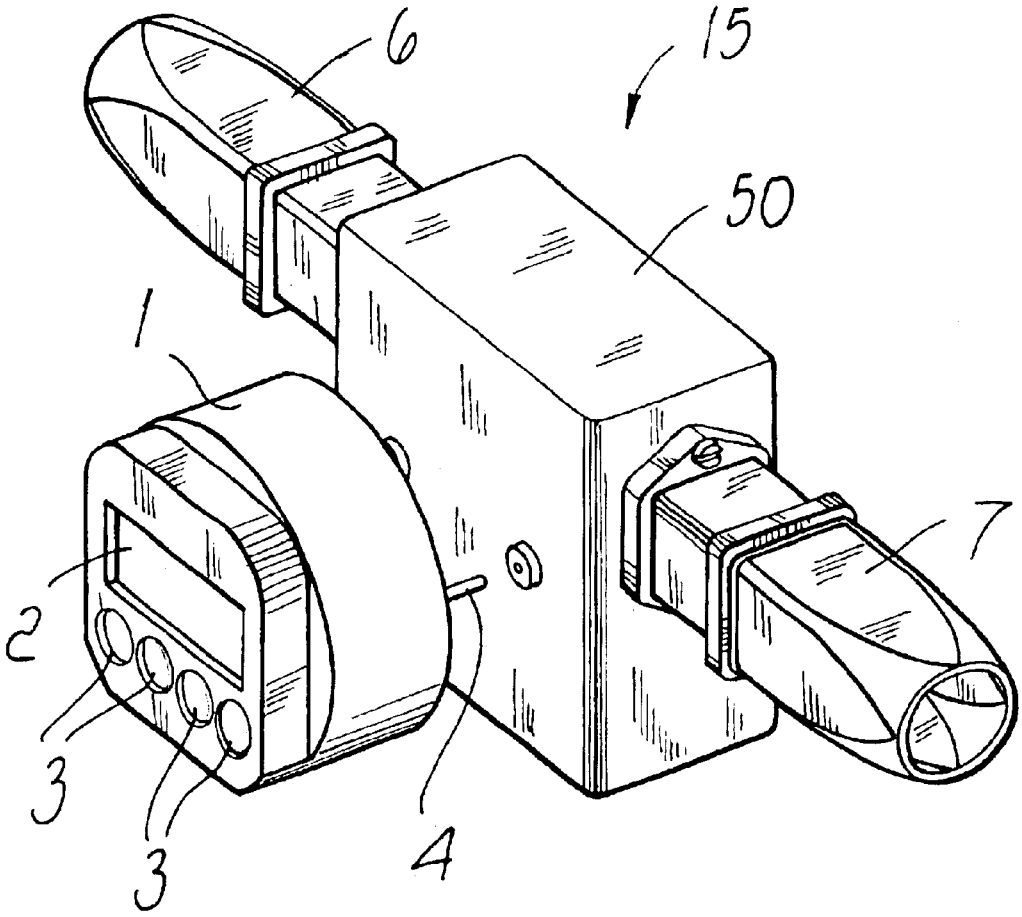
FIG. 1 is a perspective view of said third means comprised in system according to the present invention, when installed in a remote mode.

A firmware operating system 9 and/or analog/digital converting means 11 can also be comprised in said fifth means. In particular, the firmware operating system can be stored in storing means (such as an EPROM memory) or directly on a microprocessor 7. The analog converting means are particularly useful if 4–20 mA communication lines are used since they are able to convert analog current signals into digital data and vice-versa. Preferably, output connecting means are comprised in said fifth means. In a preferred embodiment, they can be the connectors 4 of FIG. 1, able to ensure the exchange of digital/analog signals directly between the portable unit 1 and an industrial transmitter or between the portable unit 1 and other devices properly arranged.

The portable unit 1 can preferably comprise also sixth means for displaying data and/or signals exchanged by the portable unit 1. The sixth means can, for example, be represented by a liquid crystal display. Means (not illustrated) for processing exchanged data and/or signals (such as a microprocessor) can also be comprised in the portable unit 1.

As described above the main characteristic of the system according to the present invention is that the third means 15 can be located remotely from first means (15) 10. In this case, third means 15 are provided with seventh means 5 for connecting the reading/programming unit 1 to said one or more data/signal transmission lines 13. In a preferred embodiment said seventh means 5 (comprising) comprises a suitable box 50 meant to be inserted, thanks to the connectors 6 and 7, on the communication lines 13, that connect the first means 10 to the second means 11. Preferably the box 50 is internally provided with supplying means (such as a Zener diode 12) which allow supplying power to the portable unit 1 directly from said one or more data/signal communication lines 13. In this case the portable unit 1 is preferably inserted with its connectors 4 across the diode 12. This solution is particularly advantageous because it allows avoiding the need for batteries for the independent operation of the portable unit 1.

In practice, it has been found that the industrial system according to the invention fully achieves the intended aims, since it allows to have a remote programming and reading with respect to the first means 10 that monitor the desired physical quantity. This fact totally eliminates installation difficulties even if said first means 10 are located in positions difficult to be accessed. Moreover, the programming of the first means 10 (i.e. of the industrial transmitters included in the industrial system according to the present invention) can always be performed in the best conditions for the user.

It should be noticed that the possibility of performing a remote programming of the first means 10 has also further advantages. In fact, the portable unit 1 can be inserted only if necessary and therefore there is no need to have one for each industrial transmitter but merely one for the "n" industrial transmitters of the system according to the present invention.

It should be noticed also that, in order to improve the flexibility of the use of the industrial system according to the present invention, the detachable means 15 can be also inserted directly on the first means 10 when possible. In this case, the portable unit 1 can be inserted directly on the corresponding transmitter without the need of the box 50.

The industrial system, according to the present invention, thus conceived is susceptible of numerous modifications and variations, all of which are within the scope of the inventive concept; all the details may furthermore be replaced with other technically equivalent elements.

In practice, the materials used, so long as they are compatible with the specific use, as well as the dimensions, may be any according to the requirements and the state of the art.

What is claimed is:

1. An industrial system for measuring a physical quantity comprising:

first means for detecting said physical quantity and for transmitting first data and/or signals related to said physical quantity; and second means for receiving said first data and/or signals, said second means being connected to said first means by means of one or more data/signal transmission lines; and third means for reading said first data and/or signals and for programming said first means, said third means being detachable from said first means and fixable in a remote position from said first means and comprising a portable reading/programming unit;

wherein said third means comprises connecting means having two connectors which are inserted in one of said data/signal transmission lines and connect in series (for serially connecting) said portable reading/programming unit to (at least one of) said one data/signal transmission line(s).

2. The industrial system, according to claim 1, wherein said connecting means comprise a box(, said box being inseerted in series to said at least one of said data/signal transmission lines and being) provided with means for supplying power to said reading/programming unit directly from said (at least) one or more of said data/signal transmission (line) lines.

3. The industrial system, according to claim 1, wherein said third means are inserted on said data/signal transmission lines, in a remote position from said first means.

4. The industrial system, according to claim 1, wherein said third means are inserted directly on said first means.

5. The industrial system, according to claim 1, wherein said first means comprises one or more industrial transmitters.

6. The industrial system, according to claim 1, wherein said data/signal transmission lines comprise 4–20 mA communication lines.

7. The industrial system, according to claim 1, wherein said portable reading/programming unit is provided with:

fourth means for programming instructions and/or signals to said first means; and fifth means for exchanging instructions and/or signals with said first means; and sixth means for reading and/or displaying said first data and/or signals; and processing means for controlling said fourth and/or said fifth means.

8. The industrial system, according to claim 3, wherein said fourth means comprise means for performing data and/or signal communication by means of a standard protocol and/or a firmware operating system and/or analog/digital converting means and/or output connecting means.

* * * * *